United States Patent [19]

Luke

[11] 4,359,090

[45] Nov. 16, 1982

[54] ANCHORING MECHANISM FOR WELL PACKER

[75] Inventor: Mike A. Luke, Houston, Tex.

[73] Assignee: Baker International Corporation, Orange, Calif.

[21] Appl. No.: 297,539

[22] Filed: Aug. 31, 1981

[51] Int. Cl.[3] ..... E21B 33/128; E21B 33/129

[52] U.S. Cl. ..... 166/217; 166/118

[58] Field of Search ..... 166/123, 124, 196, 181, 166/217, 134, 138, 139, 140, 216

[56] References Cited

U.S. PATENT DOCUMENTS

| | | | |
|---|---|---|---|
| 3,000,443 | 9/1961 | Thompson | 166/123 |
| 3,011,558 | 12/1961 | Conrad | 166/217 |
| 3,318,384 | 5/1967 | Brown | 166/134 |
| 3,361,209 | 1/1968 | Edwards, Jr. | 166/134 |
| 3,516,493 | 6/1970 | McGill | 166/134 |
| 3,871,447 | 3/1975 | Crowe | 166/124 |

*Primary Examiner*—Stephen J. Novosad
*Assistant Examiner*—Joseph Falk
*Attorney, Agent, or Firm*—Robert W. Pitts; William C. Norvell, Jr.

[57] ABSTRACT

An anchoring mechanism for a well packer includes plural bidirectional one piece slip members which are radially extendable into gripping engagement with a well conduit. The slip members are engaged by wedge surfaces on cooperating upper and lower slip cones. Only the lower slip cone is fitted with grooves which are adapted to receive laterally projecting tongues on the slip members for retaining the slip members in assembly with the remainder of the anchoring mechanism. The anchoring mechanism includes a plurality of longitudinally extending brackets having laterally projecting ears which are engageable with inclined slots cut in opposite longitudinal sides of the slip members. The bracket members are connected to the upper slip cone for movement therewith by shear screws. Relative movement of the upper slip cone and the brackets toward the lower slip cone results in setting the lower end of the slip members followed by shearing of the screws to obtain relative movement of the upper slip cone with respect to the brackets to set the upper end portion of the slip members in gripping engagement with the well conduit.

19 Claims, 8 Drawing Figures

ANCHORING MECHANISM FOR WELL PACKER

BACKGROUND OF THE INVENTION

1. Field of the Invention

The present invention pertains to anchoring means for anchoring apparatus such as a well packer in a predetermined position within a well conduit or the like, said means including a plurality of bidirectional one piece slip members which are set in the anchoring position by improved mechanism.

2. Description of the Prior Art

In the art of downhole well apparatus and other devices which are adapted to be anchored within an elongated circuit, a number of mechanisms have been developed to provide for releasably anchoring the apparatus by means of radially extendable gripping elements sometimes referred to as slips. In particular, in the art of well packers and other well devices, there are a number of arrangements which have been devised which are characterized by the provision of slip members comprising toothed segments which coact with axially movable wedge members or cones to be radially extended and retracted with respect to the longitudinal axis of the apparatus for releasably gripping the inner wall of the conduit to anchor the apparatus in a predetermined position.

One widely used design of an anchoring mechanism for well packers is characterized by sets of upper and lower unidirectional slip members which are provided with tenon or heel portions engageable with an intermediate slip ring and wherein each set of unidirectional slips is engageable with respective upper and lower wedge or cone members. The proper setting of opposed unidirectional slips can be a problem in the art of well packers and the like in that the setting mechanism does not always function to set both sets of slips with equal gripping force on the well conduit. Under such circumstances the entire axial load on the packer, as a result of fluid pressure in the well and/or the weight of tubing connected to the packer, may be imposed on only one set of slips thereby causing mechanical failure of the slips or movement of the packer from its desired position in the well.

In order to simplify the anchoring mechanism for well apparatus such as packers and the like, single piece bidirectional slips have been developed. However, most known types of single piece bidirectional slips are provided with troublesome spring type retraction members for biasing the slips into the retracted position when the cone or wedge members are moved away from each other to relieve the radial outward displacement of the slips. Moreover, known types of single piece bidirectional slip members are not adapted to be set at one end and then at the other end so that a longitudinal compressive load is placed on the slip members and a complete setting operation is assured for both ends of the slip members.

The present invention is directed to an anchoring mechanism for a well apparatus or the like including a plurality of one piece bidirectional anchoring members or slips, which mechanism overcomes many of the disadvantages of known types of slip systems and which is more economical to manufacture in conjunction with various types of downhole well apparatus adapted to be anchored within a well conduit.

SUMMARY OF THE INVENTION

The present invention provides an improved anchoring mechanism for a well packer and related apparatus wherein a set of one piece bidirectional gripping members or slips is provided in conjunction with actuating mechanism for radially extending and retracting the slips with respect to the inner wall of a well conduit.

In accordance with one aspect of the present invention, there is provided anchoring means for a well packer having a simplified and reliable actuating mechanism which assures that radially extendable slip members are set to hold the packer from displacement within the well conduit in either direction due to fluid pressures or other forces acting on the packer. The anchoring mechanism includes relatively movable actuating members which provide for setting the bidirectional slip members in gripping engagement with a well conduit and wherein spaced apart sets of gripper teeth on the slip members are sequentially set such that one set of teeth come into gripping engagement with the well conduit followed by additional applied force by a movable cone to set the other set of teeth in gripping engagement with the conduit and to place a compressive load on the slip members. The sequential setting of the slip members assures that both sets of teeth are brought into gripping engagement with the conduit in the setting operation.

In accordance with another aspect of the present invention, there is provided an improved arrangement of a plurality of bidirectional one piece slip members in combination with an improved setting and retracting mechanism wherein two spaced apart wedge or cone members are provided and wherein one of the cone members may be stationary with respect to the outer housing as well as the mandrel of the well apparatus during setting. The other cone member is provided with axially extending brackets which are engaged with the slip members along cooperating axially inclined slots to move the slip members radially outwardly and inwardly during the setting and retracting operations. In particular, the anchoring mechanism of the present invention eliminates the need for auxiliary slip retracting members such as leaf springs or the like.

In accordance with yet another aspect of the present invention, there is provided an anchoring mechanism for a well packer having a set of unique slip members, each of which is required to have only one pair of laterally projecting tongue portions disposed in complementary grooves formed in a cooperating wedge or cone member. The slip members are also provided with opposed inclined slots or grooves formed in the longitudinal sides of the slip members and which are cooperable with brackets having laterally projecting ears whereby the slip members may be retained in engagement with the remainder of the anchoring mechanism and reliably extended with respect to the well conduit.

The anchoring mechanism of the present invention may be adapted to be used in conjunction with downhole well apparatus which is set and released from a working position in engagement with a well conduit and wherein various setting mechanisms and configurations of the associated parts of the apparatus may be employed. For example, the anchoring mechanism of the present invention may be utilized with well packers which are operated to be set by relative axial movement between an outer housing assembly and an inner elongated mandrel and wherein relative movement between the housing and the mandrel is effected by various actuating means including mechanical as well as hydraulic setting mechanisms.

The anchoring mechanism, including the bidirectional one piece slip members, according to the present invention is believed to be more reliable in operation and more economical to fabricate than most conventional packer anchoring means heretofore known.

Those skilled in the art will appreciate other advantages and superior features of the anchoring mechanism of the present invention upon reading the detailed description which follows in conjunction with the drawings.

DESCRIPTION OF THE PREFERRED EMBODIMENT

Figure 1A:
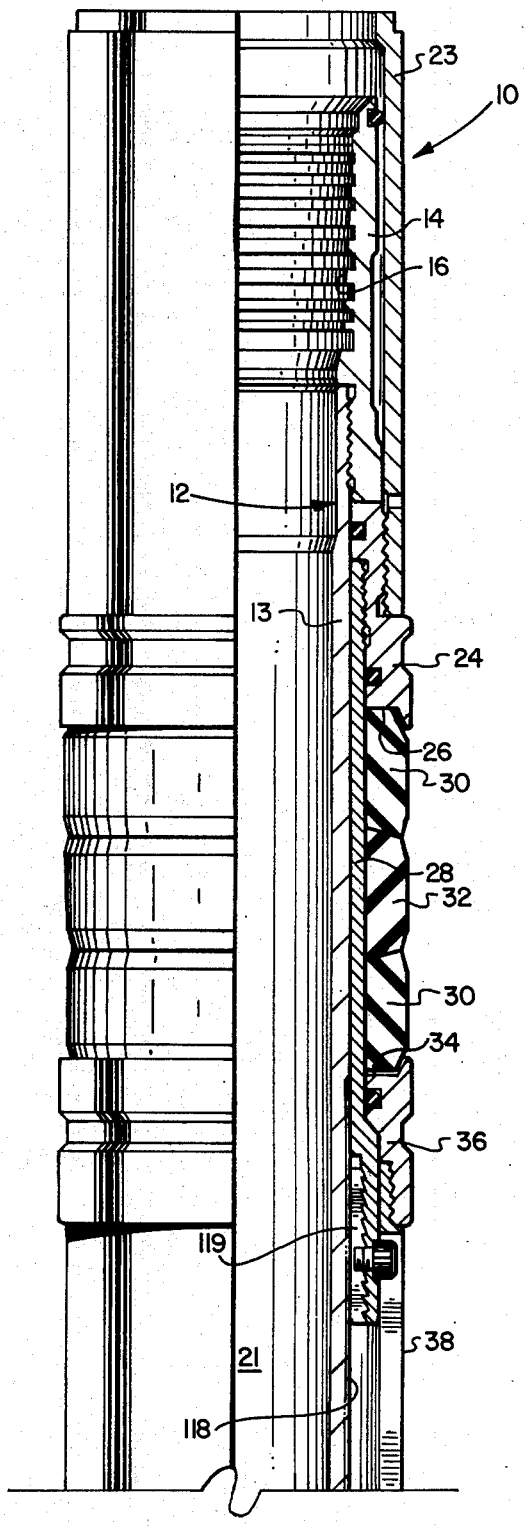
FIGS. 1A through 1C together, comprise a vertical elevation view, partially sectioned, of a downhole well apparatus including the anchoring mechanism of the present invention.

In the drawings, the figures with combined number and letter designations are intended to be viewed together arranged vertically, end to end, with the first letter designation, in alphabetical order, arranged as the top section of the view and the last letter designation arranged as the bottom section. In the following description, the terms "upper" and "lower" are used for convenience in regard to the normal arrangement of the described apparatus when it is disposed in a generally vertical well or the like. However, those skilled in the art will appreciate that the apparatus of the present invention may be used in applications wherein the apparatus may be inverted or used in a generally horizontal or inclined attitude of the longitudinal axis of the apparatus.

Figure 1B:
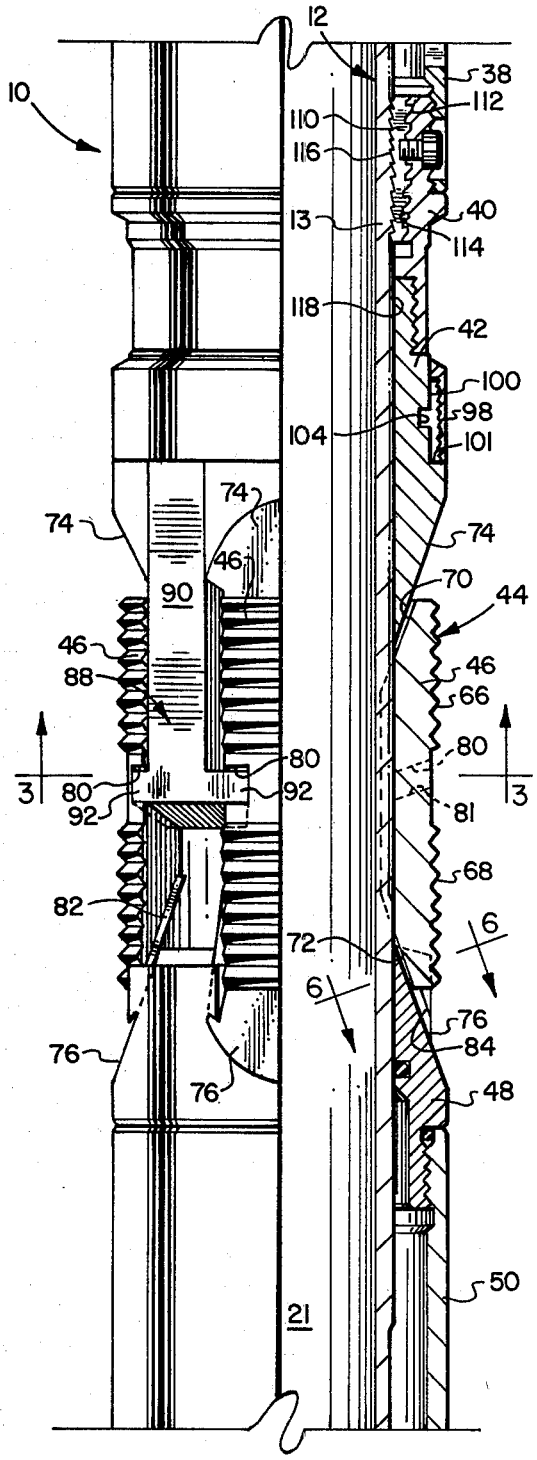
Figure 1C:
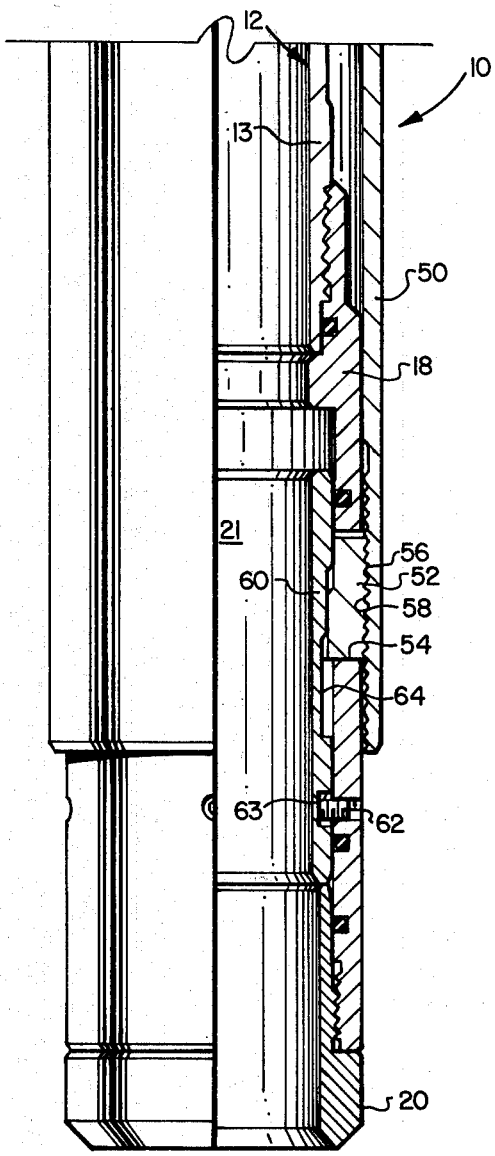

Referring to FIGS. 1A through 1C, the apparatus embodying the anchoring mechanism of the present invention is illustrated and generally designated by the numeral 10. The apparatus 10 comprises a downhole tool, commonly known as a well packer, for forming an annular seal between concentric conduits in a well, which seal may be provided for various purposes in developing or producing the well. Although the anchoring mechanism of the present invention is particularly advantageously used with the packer 10, it will be understood by those skilled in the art, that the present invention may be used in conjunction with other types of packers as well as somewhat similar apparatus adapted to be anchored within the interior of a conduit. For purposes of this discussion, the well conduit may be the well bore itself, a well casing, or other pipe or tubing disposed within the well.

Referring particularly to FIG. 1A, the packer 10 is characterized by an elongated inner member or mandrel 12 comprising a tubular member 13 having an upper end which is threadedly engaged with a sub 14. The sub 14 is provided with internal threads 16 whereby the packer 10 may be connected to the lower end of an elongated tubing or the like, not shown. The mandrel 12 extends substantially the entire length of the packer 10 and includes a removable sub 18, FIG. 1C, which is threadedly connected to the lower end of the member 13. The sub 18 is also connected to a removable collar 20 at the lower end thereof. The member 13, sub 18, and collar 20 are formed to provide a passage 21 extending entirely through the packer 10 whereby well fluids and/or equipment may be conducted for performing various operations in developing and producing an oil well, for example. The drawing FIGS. 1A through 1C comprise longitudinal half section views taken along the longitudinal central axis of the packer 10, the remaining portions of these views comprising a vertical elevation view of the packer.

Referring again to FIG. 1A, the packer 10 is also provided with an outer housing assembly made up of a number of component parts including a setting sleeve member 23 which is threadedly engaged with a cylindrical gauge ring 24 forming a downwardly facing annular shoulder 26. The gauge ring 24 is also threadedly coupled to an elongated tubular member 28 around which are disposed in sleeved relationship resilient collars 30 and 32. The collars 30 and 32 are disposed between the shoulder 26 and an upwardly facing shoulder 34 formed on a second cylindrical gauge ring 36. The gauge ring 36 is coupled to a member 38 which extends downwardly and is connected at its opposite end to a housing member or cone adaptor 40, as shown in FIG. 1B. The housing member 40 is, in turn, coupled to a cylindrical first upper wedge or cone member, generally designated by the numeral 42. The cone 42 is adapted to comprise part of an anchoring mechanism in accordance with the present invention and generally designated by the numeral 44 in FIG. 1B.

The anchoring mechanism 44 includes a plurality, preferably four, gripping members or slips 46 which are adapted to be displaced generally radially outward with respect to the longitudinal central axis of the packer 10 into forcible gripping engagement with the inner wall of a cylindrical well conduit or the like, not shown. The anchoring mechanism 44 is further characterized by a second lower wedge or cone member 48 which is disposed in sleeved relationship around the member 13 and is connected at its lower end to an elongated sleeve 50.

Referring also to FIG. 1C, the sleeve 50 extends downwardly in sleeved relationship over a portion of the sub 18 and is cooperable with the sub to remain stationary with respect thereto due to one or more interlocking segments 52, one shown in FIG. 1C. The segments 52 are disposed in elongated slots 54 formed in the sub 18 and include on their outer peripheral surfaces threads or teeth 56 which are adapted to be engaged with cooperating internal threads 58 formed on the sleeve 50. The aforedescribed parts together with an axially movable release sleeve member 60 comprise means for releasing the mandrel 12 for movement with respect to the housing assembly described hereinabove when it is desired to retrieve the packer 10 from a well conduit. The sleeve 60 is retained in position with respect to the sub 18 by one or more shear screws 62 which project into a groove 63 in the sleeve 60 to normally prevent axial displacement of the sleeve with respect to the segments 52 or the sub 18. However, upon exertion of a suitable upwardly directed force on the sleeve 60, viewing FIG. 1C, the screws 62 are sheared and the sleeve may be moved into a position whereby an annular recess 64 is positioned to allow the segments 52 to be displaced radially inwardly so that the cooperating threads 56 and 58 are disengaged. This action will permit axial movement of housing assembly including the sleeve 50 downward relative to mandrel 12.

Figure 2:
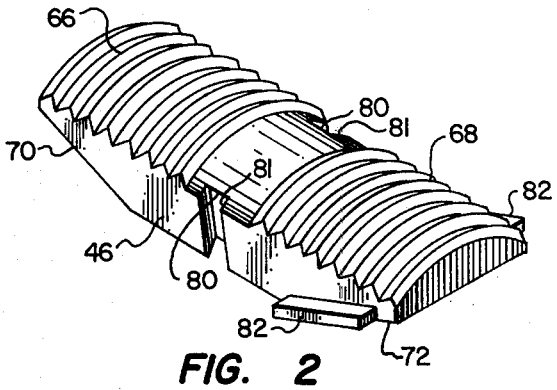
FIG. 2 is a perspective view of one of the one piece bidirectional slip members in accordance with the present invention.

Referring now to FIG. 1B and FIGS. 2 through 6 of the drawings, the anchoring mechanism 44, including the upper and lower cones 42 and 48 and the slip members 46, is adapted to provide for anchoring the packer 10 in a predetermined position within a well conduit to prevent unwanted displacement of the packer under the urging of well fluids and mechanical forces so that an annular seal may be formed in the well by the elastic deformation of the collars 30 and 32 radially outwardly into sealing engagement with the inner wall of the aforementioned conduit. The slip members 46, of which four are provided in the anchoring mechanism of the present invention and are equally spaced apart circumferentially around the member 13, are characterized as somewhat cylindrical segments made of a hardenable steel, for example. Referring to FIG. 1B and FIG. 2, in particular, the slip members 46 include respective spaced apart sets of radially projecting teeth or serrations 66 and 68 having flanks which are equilateral which form an exterior gripping surface. The slips 46 also are provided with opposed axially inclined interior planar surface portions 70 and 72 which are cooperable with respective planar surfaces 74 and 76 formed on the respective cone members 42 and 48. Each of the slip members 46 are also provided with opposed generally radially projecting slots 80 which are inclined somewhat in the same direction as the inclined surfaces 70. The inclination of the slots 80 may be, for example, approximately 15° upward, viewing FIG. 1B, from a plane parallel to the plane of FIG. 3. Note that the inclination of slots 80 and ears 92 relative to mandrel 12 is greater than the inclination of surfaces 70, 72, 74, and 76, relative to the mandrel. Each of the slip members 46 is also provided with only one set of laterally projecting tongue portions 82 adjacent to the inclined surface 72 and cooperable with complementary grooves 84, FIG. 6, formed in the cone member 48. The grooves 84 are formed along opposite parallel sides of the surface 76 and function to retain the slip members 46 is assembly with the cone member 48 in substantially all normal positions of the slip members with respect to the cone member, and to provide for movement of the slips relative to lower slip cone 48 during radial expansion and retraction of the slips. The surfaces 74 on the cone member 42 are cut in the cylindrical body of the cone member but do not have groove portions corresponding to the grooves 84.

Figure 3:
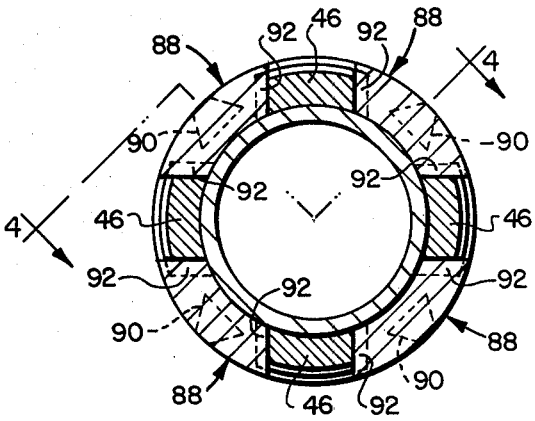
FIG. 3 is a transverse section view taken substantially along the line 3—3 of FIG. 1B.
Figure 4:
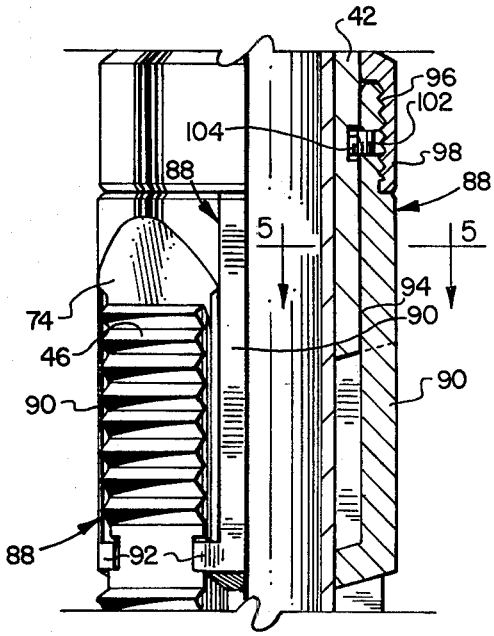
FIG. 4 is a partial longitudinal elevation view, partially sectioned, and taken along the line 4—4 of FIG. 3.

The slip members 46 are advantageously engageable with a plurality of somewhat T-shaped brackets which comprise a first interconnection means connecting the slip members to the first or upper slip cone 42 and are generally designated by the numeral 88 in FIGS. 1B, 3, 4 and 5. The brackets 88 each include an elongated stem portion 90 and opposed laterally projecting ears 92 which are engageable with the slots 80 in adjacent ones of the slip members 46 as indicated in FIG. 1B, FIG. 3 and FIG. 4. The ears 92 have inclined surface portions which are cooperable with the sidewalls of the slots 80 so that movement of the brackets 88 tends to move the slip members 46 radially outwardly or inwardly with respect to the longitudinal central axis of the packer 10 and depending on the direction of movement of the brackets. In the preferred embodiment of the anchoring mechanism of the present invention, there are four brackets 88 disposed equally spaced apart around the circumference of the cone 42.

Figure 5:
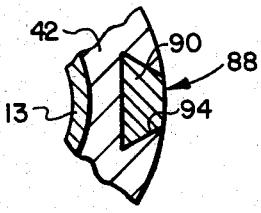
FIG. 5 is a detail section view taken along the line 5—5 of FIG. 4.
Figure 6:
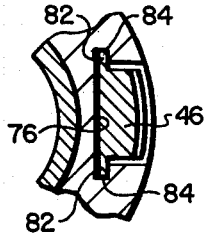
FIG. 6 is a detail section view taken along the line 6—6 of FIG. 1B.

The stem portions 90 of each of the brackets 88 are formed to have a dovetail configuration, viewed in lateral cross-section, and as illustrated by way of example in FIG. 5. The stem portions 90 are also disposed in cooperating dovetail grooves 94 which extend longitudinally along the upper cone member 42. The grooves 94 are dimensioned to provide for a close fitting but axially slidable relationship with respect to the stem portions 90. As shown in FIG. 4, the upper end of the stem portions 90 of the brackets 88 are of reduced thickness and are provided with external threads 96. The threads 96 are cooperable with complementary internal threads formed on a cylindrical retaining ring 98, as illustrated in FIG. 1B and FIG. 4. The ring 98 is disposed in surrounding relationship to a reduced diameter portion 100 of the upper cone member 42 and is abutted against a transverse shoulder 101 formed on the cone member. Each of the bracket members 88 is retained in fixed relationship with respect to the cone member 42 by a shear pin comprising a socket head screw 102 threadedly engaged with the upper end of the stem portion 90 and projecting radially into a circumferential groove 104 formed in the reduced diameter portion 100 of the cone member.

The arrangement of the brackets 88 and the cone member 42 provides for radially outward displacement and sequential setting of the slip members 46 in a manner which provides improved gripping of a well conduit or the like in which the packer 10 would be disposed in use. The dimensional relationship of the grooves 80 and the surface 70 on the slip members 46 with respect to the bracket members 88 and the upper slip cone 42 is such that the ears 92 of the bracket members 88 engage the lower sidewalls 81 of the opposed slots 80 before the surface 74 becomes forcibly engaged with the surface 70 on the slip member. Accordingly, upon downward movement of the upper slip cone 42 with respect to the mandrel 12 and the lower cone member 48, which is stationary with respect to the mandrel, the ears 92 cooperate with the slots 80 to force the slip members 46 radially outwardly, with respect to the central longitudinal axis of the packer 10, due also to engagement of the surfaces 72 with the cooperating wedge surfaces 76 on the cone member 48. Upon forcible engagement of the teeth 68 with the conduit, not shown, the bracket members 88 resist further movement and the teeth 68 become forcibly set in engagement with the inner surface of the conduit. The resultant force of engagement of the lower portion of the slip member 46 including the teeth 68 with the conduit, is related to the force required to shear the screws 102 under the downward imposed force on the cone member 42. The shear strength of the screws 102 is, of course, predetermined to be such that they will shear before a failure of the ears 92, for example, would be experienced. The slots 84 are also dimensioned with respect to the tongues 82 such that, as the slip member 46 is moved radially outwardly into engagement with the well conduit, enough clearance is provided between the slots and the tongue portions 82 to allow a slight pivoting clockwise, of the slip member 46 shown in section in FIG. 1B, about the lower end of the slip member.

When the teeth 68 on the slip members 46 have engaged the aforementioned conduit sufficiently to remain in a set position with respect thereto, continued downward urging of the cone member 42 will cause the screws 102, which comprise shearable releasing means, to shear thereby resulting in relative movement of the cone member 42 with respect to the brackets 88 so that the surfaces 74 engage the respective surfaces 70 to urge the teeth 66 into forcible engagement with the well conduit. Those skilled in the art will appreciate that the sequential setting of the slip members against the inner wall of the conduit, as provided by the brackets 88 and the slip cone 42, will provide an axial compressive load on the slip members in the set position to further enhance the anchoring action of the slips. The sequential setting of the bidirectional single piece slip members 46 as described above, assures that both sets of gripping teeth 66 and 68 are forcibly engaged with the conduit in which the packer 10 is disposed and thereby eliminates the need for the application of an upward pulling force or "tension" on the packer to assure that the lower end of the slip is set, as is required with unidirectional type slips and some prior art single piece bidirectional slips.

Moreover, by providing the slip members 46 with laterally projecting tongues on the lower portion only and cooperable with grooves formed in only the lower slip cone member, there is no tendency for tensile loading of the slip members to occur under forces exerted on the packer 10. Only a compressive load can be exerted on the slip members by the upper cone member 42 since no cooperating grooves and tenons are provided between these members. Furthermore, the provision of bidirectional single piece slip members eliminates the arrangement of upper and lower unidirectional slips which are interconnected by an intermediate slip ring and which can impose tensile loading on one or the other set of slips under certain forces acting on the packer assembly.

The packer 10 may be actuated to set the slips 46 as well as the sealing collars 30 and 32 by exerting an axial downward force on the setting sleeve 23 with respect to the mandrel 12. This setting force may be accomplished by various means and in the exemplary packer 10 may be carried out by known apparatus such as the combination of a Model E4 wire line pressure setting assembly and a Model B wire line adapter kit manufactured by Baker Packers Completion Systems, Houston, Tex. The operation of the aforementioned equipment, when carried out to provide a downward force on the setting sleeve 23 with respect to the mandrel 12, will result in axially applied downward forces on the gauge ring 36, the housing member 38, intermediate member 40 and the cone member 42. Accordingly, from the retracted position shown in FIG. 1B, upon application of a downward force on the setting sleeve 23, the cone 42 will move downward with respect to the mandrel 12 together with the brackets 88 to initially move the slip members 46 radially outwardly as the slip surfaces 72 engage and slide along the wedge surfaces 76. The lower cone 48 thereby provides a wedging action on the lower portion of the slip members 46 to assure that a radial outward force is imposed on the slip members. When the reaction force on the brackets 88 exceeds the shear strength of the screws 102, they will shear to allow the cone 42 to move downward relative to the brackets 88 and the cone 48 so that the wedge surfaces 74 engage the cooperable slip surfaces 70 on the slip members thereby providing a wedging action which will cause the teeth 66 to forcibly engage the well conduit also.

After the slip members 46 have been set in gripping engagement with the conduit and subjected to a substantially longitudinally applied compressive load, the cone member 42 will remain in the set position thanks to the action of a body lock ring 110, illustrated in FIG. 1B. The body lock ring 110 is of a type known in the art of well packers and comprises a cylindrical ring which is provided with relatively coarse buttress type threads or wickers 112 formed on the outer circumference thereof and which are cooperable with complementary internal wickers 114 formed on the member 40. The body lock ring 110 is also provided with relatively fine pitch wickers 116 which are engageable with complementary wickers 118 formed on the circumference of the tube 13. The configuration of the cooperating wickers 116 and 118 is such that upon movement of the member 40 together with the lock ring 110 downwardly, the wickers 116 will ratchet over the wickers 118 and, upon cessation of downward movement of the member 40, as well as the cone 42, the wickers 116 and 118 will engage to prevent upward movement of the member 40 and the cone member 42 with respect to the mandrel 12, viewing FIG. 1B.

Accordingly, once the slip members 46 have been set as described above, they can only be retracted by release of the sleeve 50 to move downwardly, relative to the mandrel 12 along with the slip cone 48. This action is accomplished by actuation of the aforedescribed release mechanism. Upon setting of the slip members 46 radially outwardly, continued downward movement of the setting sleeve 23 deforms the resilient sealing collars 30 and 32 radially outwardly into sealing engagement with the inner wall of the well conduit in a manner known in the art of well packers. The sleeve 28 is also engaged with a body lock ring 119, FIG. 1A, which is cooperable with the wickers 118 to lock the sleeve 28 and the ring 24 in a position wherein the sealing collars 30 and 32 remain radially deformed into sealing engagement with the conduit. The packer is then set in the working position and will remain there until actuation of the release mechanism described above.

Release of gripping slip elements 46 is accomplished by means of a release sleeve 60 which, through the use of a conventional wireline tool, can be axially shifted to release housing 50. Exertion of an upward force upon sleeve 60 will result in shearing screw 62 upon the application of a predetermined longitudinal shear force. Release sleeve 60 is then free to move upward relative to mandrel 12 and housing sleeve 50. After a small amount of axial movement of release sleeve 60, annular groove 64 can be positioned beneath segments 52, permitting these segments to move radially inward. Inward movement of segments 52 will release the engagement between threads 56 on segment 52 and threads 58 on housing sleeve 50. Housing sleeve 50 is then free to move downward relative to mandrel 12. Movement of housing sleeve 50 will also result in movement of lower slip cone member 48 which is now free to move out of supporting relationship to slips 46. As housing sleeve 50 and slip cone 48 move downward relative to mandrel 12, inclined tongues 82 on slip elements 46 will result in the inward movement of the slips 46. Bracket ears 92 are also free to move radially within slots 81. The retraction of slips 46 can thus be positively accomplished without the need of springs to assist retraction. Slips 46 will also be free to pivot about the central engagement between bracket ears 92 and slots 81. Any tendency of the slips to bind or hang which could result from the use of tongue members similar to tongues 82 on the upper inclined surface of slips 46 will then be minimized. Of course, as lower cone 48 moves downward relative to mandrel 12 withdrawing slip 46 with it, the slip will also move relative to upper cone 42 with inclined surface 70 sliding along upper wedge surface 74. If cone member 48 and sleeve 50 do not move downward of their own weight or under the urging of fluid pressure, the relative upward movement of the mandrel 12 in response to a pulling action on the tubing string will cause sub 14 to engage the upper end of sleeve 23. Further upward movement of the mandrel and sleeve 23 will result in upward movement of the cone member 42 and the brackets 88 through the connection between the mandrel 12 and the cone member formed by sleeve 28, ring 36, and the members 38 and 40. Upward movement of cone member 42 will cause the slip members 46 to retract radially inwardly thanks to the engagement of the slots 80 with the ears 92. The tongues 82 which are at least always approximately disposed within grooves 84 will also cause slips 46 to retract inwardly. Continued upward movement of cone member 42 and brackets 88 will eventually cause the slip members to retract radially inward to the position shown in FIG. 1B, whereby the packer may be easily retrieved from the well conduit without damaging the slip members. The opportunity for slips 46 to bind during either expansion or contraction is reduced due to the central positioning of the bracket to slip interconnection and because this central interconnection is along a relatively steeper angle than the inclination of the sole tongue and groove interconnection with the lower slip cone member.

Those skilled in the art will appreciate from the foregoing that a unique and superior anchoring mechanism has been provided for a well packer, such as the packer 10 illustrated, but which also may be used in conjunction with other types of packers utilizing different setting mechanisms. Moreover, the anchoring mechanism of the present invention may also be adapted for use with other types of apparatus primarily designed for insertion in an elongated conduit such as a well bore or casing. Those skilled in the art will also appreciate that various modifications may be made to the specific embodiment disclosed herein without departing from the scope and spirit of the appended claims.

What is claimed and desired to be secured by Letters Patent is:

1. In an apparatus adapted to be anchored within a well conduit and the like, a tubular mandrel, housing means disposed in sleeved relationship around said mandrel, and an anchoring mechanism disposed around said tubular mandrel for gripping the wall of said conduit to hold said apparatus in a predetermined position upon relative movement between said mandrel and said housing means, said anchoring mechanism comprising:

a plurality of slip members spaced apart circumferentially around said mandrel, each slip member, including an exterior gripping surface and interior axially inclined surfaces, extending toward the opposite ends of said slip members;

first and second opposed relatively axially movable slip cone members, including wedge surfaces cooperable with said inclined surfaces on said slip members to hold said slip members radially outward when said first and second slip cone members have moved relatively towards each other;

first means comprising brackets extending between adjacent spaced apart slip members releasably engageable with said first cone member and connected to said slip members for moving said slip members axially into and out of cooperable engagement with the wedge surface on said second slip cone member, said slip members being free to move radially relative to said first means;

second means interconnecting said slip members with said second cone member for allowing simultaneous radial and axial movement of said slip members relative to said second slip cone member; and releasing means for disengaging said first means from said first cone member after said slip members have been radially expanded, permitting said first slip cone member to move axially toward said slip members with the wedge surface on said first slip cone member moving into supporting relationship to the cooperable inclined surface on said slip members.

2. The apparatus of claim 1 wherein said brackets form a radially slideable connection with said slip members intermediate the ends of each slip member.

3. The apparatus of claim 2 wherein said first slip cone member moves axially within said brackets upon disengagement of said brackets from said first slip cone member.

4. The apparatus of claim 1 wherein second means comprise an axially inclined tongue and groove interconnection between said second slip cone member and said slip members.

5. The apparatus of claim 4 wherein said tongue and groove interconnection is adjacent the intersection of said second slip cone member wedge surface and the cooperable inclined surfaces on said slip members.

6. The apparatus of claim 1 wherein said releasing means comprises shearable means.

7. The apparatus of claims 1, 2, 3, 4, 5, or 6, wherein initial radial expansion of said slip members occurs upon engagement of said second slip cone member wedge surface with the cooperable inclined surface on said slip member prior to disengagement between said first means and said first slip cone member.

8. The apparatus of claims 1, 2, 3, 4, 5, or 6, wherein said second means moves said slip members radially inward upon relative axial movement of said second longitudinally movable slip cone member away from said first slip cone member.

9. In an apparatus adapted to be anchored within a subterranean well conduit and the like, a tubular mandrel, housing means disposed in sleeved relationship around said mandrel, and an anchoring mechanism disposed around said mandrel for gripping the wall of said conduit to hold said apparatus in a predetermined position upon relative movement between said mandrel and said housing means, said anchoring mechanism comprising:

a plurality of slip members spaced apart circumferentially around said mandrel, each slip member, including an exterior gripping surface and interior axially inclined surfaces, extending toward the opposite ends of said slip members;

first and second opposed relatively axially movable slip cone members, including wedge surfaces cooperable with said inclined surfaces on said slip members to hold said slip members radially outward when said first and second slip cone members have moved relatively towards each other;

first means comprising brackets extending axially between adjacent spaced apart slip members releasably engageable with said first cone member and connected to said slip members for moving said slip members axially into cooperable engagement with the wedge surface on said second slip cone member, said slip members being free to move radially relative to said first means;

releasing means for disengaging said first means from said first cone member after radial expansion of said slip members, said first slip cone means then being free to move axially relative to said slip members into supporting relationship to the cooperable inclined surface on said slip members; and second means interconnecting said slip members with said second slip cone member for moving said slip members radially inwardly as said second slip cone member moves relatively away from said first slip cone member.

10. The apparatus of claim 10 wherein said brackets form a radially slideable connection with said slip members intermediate the ends of each slip member.

11. The apparatus of claim 10 wherein said first slip cone member moves axially within said brackets upon disengagement of said brackets from said first slip cone member.

12. The apparatus of claim 9 wherein second means comprise an axially inclined tongue and groove interconnection between said second slip cone member and said slip members.

13. The apparatus of claim 12 wherein said tongue and groove interconnection is adjacent the intersection of said second slip cone member wedge surface and the cooperable inclined surfaces on said slip members.

14. The apparatus of claim 9 wherein said releasing means comprises shearable means.

15. The apparatus of claims 9, 10, 11, 12, 13, or 14, wherein initial radial expansion of said slip members occurs upon engagement of said second slip cone member wedge surface with the cooperable inclined surface on said slip member prior to disengagement between said first means and said first slip cone member.

16. The apparatus of claims 9, 10, 11, 12, 13, or 14, wherein said second means moves said slip members radially inward upon relative axial movement of said second longitudinally movable slip cone member away from said first slip cone member.

17. In an apparatus incorporable on a first conduit adapted to be anchored within a subterranean well to an exterior conduit, a tubular mandrel and an anchoring mechanism disposed between said mandrel and said exterior conduit for gripping the wall of said exterior conduit to hold said apparatus in a predetermined position, said anchoring mechanism comprising:

at least one slip member having an exterior gripping surface and interior slip surfaces, inclined relative to said mandrel, extending toward the opposite ends of said slip member;

first and second opposed relatively axially movable slip cone members, said slip cone members having wedge surfaces inclined relative to said mandrel for cooperation with said slip surfaces to hold said slip members radially outward when said first and second slip cone members have moved relatively towards each other;

first means releasably engageable with said first slip cone member and forming a slideable connection immediate the center of said member with said slip member, said slideable connection having an inclination relative to said mandrel greater than the inclination of said interior slip surface and said wedge surfaces; and second means slideably interconnecting said slip member with said second slip cone member, said second means comprising a tongue and groove interconnection having an inclination relative to said mandrel approximately equal to the inclination of said slip surfaces and said wedge surfaces.

18. The apparatus of claim 17 further comprising shearable releasing means between said first means and said first slip cone member.

19. In an apparatus adapted to be anchored within a well conduit and the like, a tubular mandrel, housing means disposed in sleeved relationship around said mandrel, and an anchoring mechanism disposed around said tubular mandrel for gripping the wall of said conduit to hold said apparatus in a predetermined position upon relative movement between said mandrel and said housing means, said anchoring mechanism comprising:

a plurality of slip members spaced apart circumferentially around said mandrel, each slip member, including an exterior gripping surface and interior axially inclined surfaces, extending toward the opposite ends of said slip members;

first and second opposed relatively axially movable slip cone members, including wedge surfaces cooperable with said inclined surfaces on said slip members to hold said slip members radially outward when said first and second slip cone members have moved relatively towards each other;

first means releasably engageable with said first cone member and connected to said slip members for moving said slip members axially into and out of cooperable engagement with the wedge surface on said second slip cone member, said slip members being free to move radially relative to said first means;

second means comprising tongue and groove means for interconnecting said slip members with said second cone member for allowing simultaneous radial and axial movement of said slip members relative to said second slip cone member; and releasing means for disengaging said first means from said first cone member after said slip members have been radially expanded, permitting said first slip cone member to move axially toward said slip members with the wedge surface on said first slip cone member moving into supporting relationship to the cooperable inclined surface on said slip members.

* * * * *